United States Patent [19]

Yamashita et al.

[11] 4,441,636

[45] Apr. 10, 1984

[54] TONER CARTRIDGE

[75] Inventors: Keitaro Yamashita, Saitama; Hiromi Kashiwagi, Kumagaya, both of Japan

[73] Assignee: Hitachi Metals, Ltd., Tokyo, Japan

[21] Appl. No.: 390,645

[22] Filed: Jun. 21, 1982

[30] Foreign Application Priority Data

Jun. 23, 1981 [JP] Japan ..... 56-97059

[51] Int. Cl.[3] ..... B65D 47/10

[52] U.S. Cl. ..... 222/541; 222/DIG. 1

[58] Field of Search ..... 222/DIG. 1, 541; 355/3 R, 3 DD, 14, 8; 118/653

[56] References Cited

U.S. PATENT DOCUMENTS 3,923,391 12/1975 Washio ..... 355/3 R 4,089,601 5/1978 Navone ..... 222/DIG. 1

*Primary Examiner*—Stanley H. Tollberg

*Attorney, Agent, or Firm*—Antonelli, Terry & Wands

[57] ABSTRACT

A toner cartridge including a hollow body of cylindrical form made of nonmagnetic material to serve as a container formed at its outer peripheral surface with a toner feeding slot extending lengthwise thereof, a first lid member attached to one end of the hollow body and formed at the outer peripheral surface of its end portion with a flange, a second lid member attached to the other end of the hollow body and formed at its bottom with a toner supply port, a cap member closing the toner supply port, and a sealing member that can be peeled off closing the toner feeding slot formed at the outer peripheral surface of the hollow body. The second lid member is formed of thin sheet metal by bending same at its outer peripheral edge portion in a manner to provide a minuscule clearance between a bent portion and the thin sheet metal and the hollow body is inserted at the other end thereof in the bent portion and secured in place. The hollow body is formed at its outer peripheral surface with a groove and the first lid member is formed at its outer periphery with a projection, so that the projection can be brought into locking engagement in the groove when the first lid member is attached to the hollow body.

2 Claims, 8 Drawing Figures

TONER CARTRIDGE

BACKGROUND OF THE INVENTION

1. Field of the Invention

The present invention relates to a toner cartridge suitable for use in supplying a developing device of the dry type with powdery toner.

2. Description of the Prior Art

In electrophotographic copying apparatus of the dry type or printers, a developer of the binary system consisting of a nonmagnetic toner in powder form serving as a developing powder and an iron powder serving as a carrier has hitherto been in use. Other types of developing agent that have also been in use include a magnetic toner of the one-component system containing a resin and ferro magnetic fine particles as principal components, and a mixture of nonmagnetic toner and magnetic toner.

In supplying developing devices with various types of toner, it is becoming popular to use a toner cartridge which is housed within a developing device. A cartridge for supplying a developing device with a toner generally comprises an elongated hollow body closed at opposite ends and formed on its peripheral wall with a toner feeding slot which is sealed by a sealing member. These cartridges are disclosed, for example in Japanese Patent Laid-open Publication No. 117055/74.

Some cartridges disclosed, for example in Japanese Utility Model Laid-Open Publication No. 1246/80 comprise an elongated trough-like body with wings formed at its outer surface. The elongated body is guided by the wings and introduced into a developing device. When the elongated body is inserted deep into the developing device, the elongated body is turned so as to supply a developing device with a toner. In addition, Japanese Patent Laid-Open Publication No. 48660/81 and Japanese Patent Laid-Open Publication No. 52779/81 disclose toner supplying devices each using a toner cartridge.

The toner cartridges of the prior art described hereinabove would be faced with the problems that, even if they facilitate to supply a developing device with a toner, their constructions and/or the constructions for receiving the cartridge fitted therein would become complex and require much labor to assemble them together.

SUMMARY OF THE INVENTION

It is an object of the present invention to overcome the aforesaid problems. It is another object of the present invention to provide a cartridge for supplying a developing device with a fresh toner which is simply constructed and readily assembled and which enables to supply a fresh toner in a single operation.

According to the present invention, there is provided a toner cartridge comprising a cylindrical hollow body of nonmagnetic material providing at its outer peripheral surface with a toner feeding slot extending lengthwise thereof, a first closing member fitted to one end of the hollow body and having a flange portion on the outer peripheral surface at the end portion thereof, a second closing member fitted to the other end of the hollow body and having a toner introduction port which is sealed by a plug member, said toner feeding slot being sealed by a peelable sealing member, wherein said second closing member is formed of a thin metallic sheet, one end portion of said second closing member is folded back so as to define a gap having a small radial width between the folded end portion and the outer peripheral surface of the second closing member, and said the other end of the hollow body is inserted into said gap and secured to said second closing member.

The present invention will be made more apparent by the following description with reference to the accompanying drawings.

DESCRIPTION OF THE PREFERRED EMBODIMENT

Figure 1:
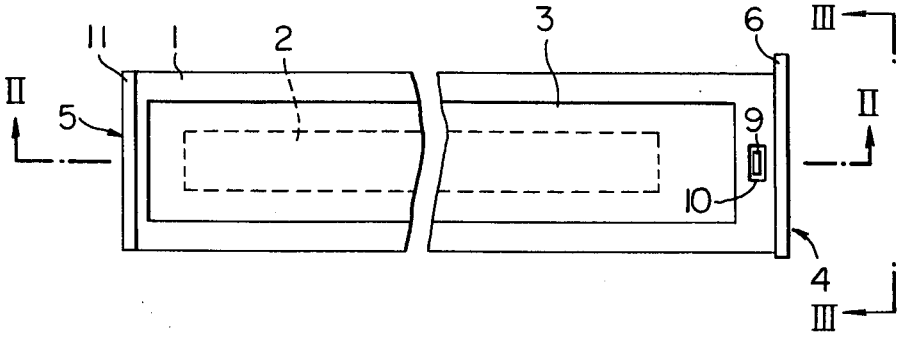
FIG. 1 is a plan view of a toner cartridge embodying the present invention.
Figure 2:
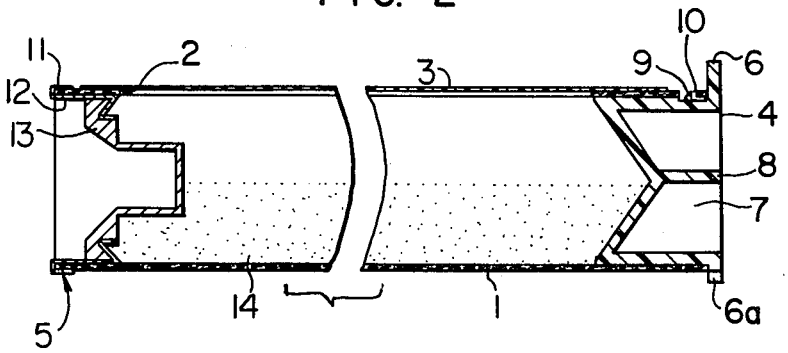
FIG. 2 is a sectional view taken along the line II—II in FIG. 1.
Figure 3:
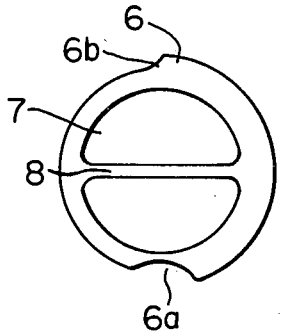
FIG. 3 is a view as seen in the direction of arrows III—III in FIG. 1.

Referring to FIG. 1, the numeral 1 designates an elongated cylindrical hollow body made of nonmagnetic material, such as paper, plastics, etc. The hollow body is provided with a toner feeding slot 2 on the peripheral wall thereof extending lengthwise which is sealed by a sealing member 3. Preferably the hollow body 1 is made of paper sheet to reduce the production cost, and in this case, its thickness may be suitably selected depending on its length and outer diameter. For example, when the outer diameter and the length of the hollow body are in the range between 40 and 50 mm and up to 400 mm respectively, its thickness may be about 1 mm.

Figure 4A:
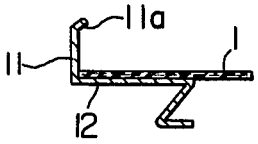
FIGS. 4 (*a*) and 4 (*b*) are enlarged fragmentary sectional views showing an essential part of the toner cartridge shown in FIG. 1 in explanation of the manner of assembling the same.
Figure 4B:
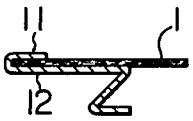

The hollow body has closing lids 4 and 5 secured to opposite ends thereof respectively so as to define a toner container therein. The closing lid 4 is made of flexible material, such as plastics and comprises a flange 6 at end portion thereof. The end surface of the closing lid 4 adjacent to the flange 6 is formed with recesses 7, 7 defining a knob 8 therebetween. The flange 6 has a half circumferentially extending substantial 180 degrees the radius of which is slightly smaller than that of the other half thereof. The closing lid 4 is provided on a portion of the outer periphery thereof with a projection 9 adapted to be engaged with a groove 10 formed on the peripheral wall of the hollow body to prevent the closing lid 4 removing from the hollow body 1 when the closing lid 4 is fitted to the hollow body 1. The closing lid 5 is made of a thin metallic sheet, such as a tin, an aluminum and so on. The closing lid 5 comprises a cylindrical portion 12, a flange portion 11 extending radially outwardly and attached to one end of the cylindrical portion 12 and a flange portion extending radially inwardly to define a central opening and attached to the other end of the cylindrical portion 12. The closing lid 5 is affixed to the hollow body 1 as follows: As shown in FIG. 4 (*a*), a cylindrical portion 12 is first brought into contact with the inner peripheral surface of the hollow body 1, and then, as shown in FIG. 4 (*b*), a flange portion 11 is bent so as to hold the end portion of the hollow body 1 between the outer periphery of the cylindrical portion 12 and the flange portion 11. In this case, in order to facilitate bending of the flange portion 11, the flange portion 11 preferably has a thickness below 0.5 mm, and more preferably in the range between 0.2 to 0.4 mm. By slightly folding a radial outer end portion 11*a* of the flange portion 11 beforehand as shown in FIG. 4 (*a*), it is possible to more firmly affix the closing lid 5 to the hollow body 1 because the end portion 11*a* bites into the outer peripheral surface of the hollow body 1. After the closing lids 4 and 5 are secured to the hollow body 1, a toner 14 is filled into the hollow body 1 through the opening of the flange of the closing lid 5 and a plug 13 is inserted into the opening to form a toner cartridge.

Figure 5:
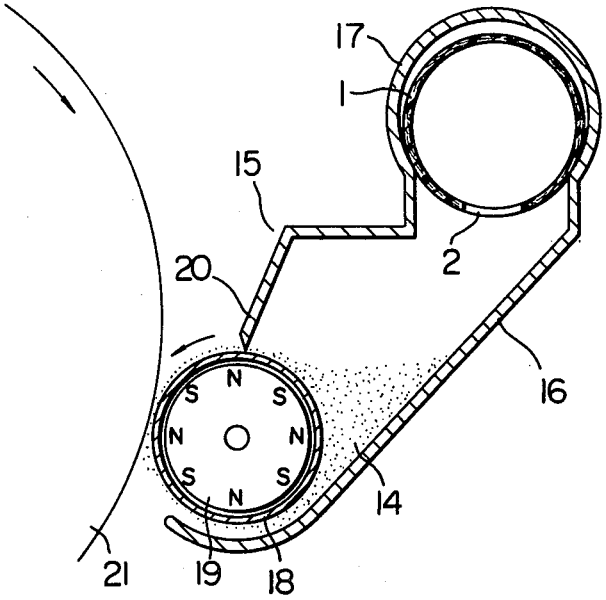
FIG. 5 is a sectional view of a developing device housing therein the toner cartridge shown in FIG. 1.
Figure 6:
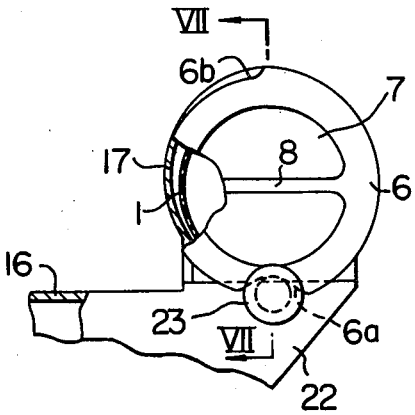
FIG. 6 is a fragmentary side view of an essential part of the developing device shown in FIG. 5 as seen from the side at which the toner cartridge is inserted.
Figure 7:
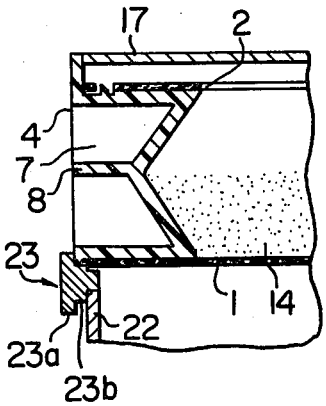
FIG. 7 is an enlarged fragmentary sectional view taken along the line VII—VII in FIG. 6.

The toner cartridge is housed within a developing device as shown in FIGS. 5 to 7. The toner cartridge may be applied into the developing device as follows. The sealing member 3 is peeled off the hollow body 1 of the toner cartridge and the hollow body 1 located in a position in which the toner feeding slot 2 faces upwardly is forced into a toner housing 17 of the developing device 15 while the bottom surface of the hollow body 1 is abutted against a large diameter portion 23*a* of a guide 23 projecting from a side plate 22 of the developing device 15. As the flange 6 reaches the major diameter portion 23*a* following the hollow body 1, the flange 6 climbs over the portion 23*a* through a notch 6*a* formed in the flange 6 and engages a minor diameter portion 23*b* at the notch 6*a* as shown in FIGS. 6 and 7. After the hollow body 1 of the toner cartridge is inserted in the toner housing 17 until the flange 6 abuts against the end surface of the housing 17, the knob 8 is gripped and the hollow body 1 is turned in the direction of an arrow shown in FIG. 6 to cause the hollow body 1 to make a revolution substantially through 180 degrees until a round edge portion 6*b* of the flange 6 is brought into locking engagement with the minor diameter portion 23*b*, thereby permitting the toner 14 to be fed through the toner feeding slot 2 into a toner box 16. The toner 14 thus fed into the toner box 16 is conveyed in the direction of an arrow shown in FIG. 5 by virtue of relative rotations of a nonmagnetic sleeve 18 located opposite to a photosensitive drum 21 and a permanent magnet roll 19 including a plurality of magnetic poles located on the peripheral portion thereof, e.g. the rotation of the sleeve 18, so that the toner 14 adheres to an electrostatic latent image (not shown) formed on the surface of the photosensitive drum 21 to develop the same into a visible image. The numeral 20 designates a doctor blade for regulating the thickness of the toner on the sleeve 18. The handle portion may extend to the direction perpendicular to the direction of the handle portion 8 shown in FIG. 6.

In the aforesaid toner cartridge, in order to avoid degeneration or agglomeration of the toner particles due to the influence of humidity and temperature, the sealing member 3 is preferably made of nonmagnetic material of high airtightness, such as a plastic sheet, aluminum foil, kraft paper lined with silver paper, etc. For example, a transparent plastic tape of a thickness of about 0.05 mm may be used for forming the sealing member 3. In order to firmly affix the sealing member 3 to the toner feeding slot 2 of the hollow body 1, the sealing member 3 may be affixed in following manners. An adhesive agent generally so-called "hot melt" which consists of copolymer of ethylene and vinyl acetate and wax is applied to the surface of the sealing member 3 to be affixed to the hollow body 1 and, after the sealing member 3 is superposed on the outer peripheral surface of the hollow body 1 to overlap the toner feeding slot 2, the sealing member 3 is heated for several seconds at a temperature in the range between 100° and 200° C.

From the foregoing description, it will be appreciated that the toner cartridge according to the invention is simply constructed and readily assembled and permits a fresh toner to be smoothly fed into the developing device.

What is claimed is:

1. A toner cartridge comprising:

a cylindrical hollow body of nonmagnetic material providing on a peripheral wall thereof with a toner feeding slot extending lengthwise;

a first closing member fitted to one end of said hollow body and having a flange portion on the outer peripheral surface at the end portion thereof;

a second closing member fitted to the other end of said hollow body and having a toner introduction port therein;

a plug member closing said toner introduction port; and a sealing member peelably sealing said toner feeding slot; wherein said second closing member is formed of a thin metallic sheet, one end portion of said second closing member is folded back so as to define a gap having a small radial width between the folded end portion and the outer peripheral surface of the second closing member, and said the other end of the hollow body is inserted into said gap and secured to said second closing member.

2. A toner cartridge as claimed in claim 1, wherein said hollow body is formed at a portion of the periphery wall thereof with a groove and said first closing member is formed at a portion of the outer peripheral surface with a projection, said projection being brought into locking engagement in said groove.

* * * * *